US011222618B2

(12) United States Patent
Tanoue

(10) Patent No.: US 11,222,618 B2
(45) Date of Patent: Jan. 11, 2022

(54) SOUND SIGNAL GENERATION DEVICE, KEYBOARD INSTRUMENT, AND SOUND SIGNAL GENERATION METHOD

(71) Applicant: YAMAHA CORPORATION, Hamamatsu (JP)

(72) Inventor: Michiko Tanoue, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 60 days.

(21) Appl. No.: 16/800,479

(22) Filed: Feb. 25, 2020

(65) Prior Publication Data

US 2020/0193949 A1 Jun. 18, 2020

Related U.S. Application Data

(63) Continuation of application No. PCT/JP2017/033915, filed on Sep. 20, 2017.

(51) Int. Cl.

| | |
|---|---|
| ***G10H 1/053*** | (2006.01) |
| ***G10H 1/00*** | (2006.01) |
| ***G10H 1/34*** | (2006.01) |

(52) U.S. Cl.

CPC ..... *G10H 1/053* (2013.01); *G10H 1/0008* (2013.01); *G10H 1/348* (2013.01); *G10H 2220/221* (2013.01)

(58) Field of Classification Search

CPC ..... G10H 1/053; G10H 1/0008; G10H 1/348; G10H 2220/221

(Continued)

(56) References Cited

U.S. PATENT DOCUMENTS 5,569,870 A * 10/1996 Hirano ..... G10H 1/0575 84/615
5,827,987 A * 10/1998 Kosugi ..... G10H 1/125 84/604

(Continued)

FOREIGN PATENT DOCUMENTS

JP H05249965 A 9/1993
JP H0784574 A 3/1995

(Continued)

OTHER PUBLICATIONS

International Search Report issued in Intl. Appln. No PCT/JP2017/033915 dated Nov. 28, 2017. English translation provided.

(Continued)

*Primary Examiner* — Christina M Schreiber
(74) *Attorney, Agent, or Firm* — Rossi, Kimms & McDowell LLP

(57) ABSTRACT

A sound signal generation device according to one embodiment includes a memory storing instructions, and a processor that implements the instructions and execute a plurality of tasks, including a signal generation task that generates a sound signal based on first operation data corresponding to an operation to a key, and an attenuation control task that controls an attenuation velocity of the sound signal to one of a first velocity or a second velocity that is faster than the first velocity, based on the first operation data, and second operation data corresponding to an operation to a pedal, wherein the attenuation control task varies a value of the second velocity based on an operation velocity of the key included in the first operation data to control the attenuation velocity of the sound signal to the second velocity.

16 Claims, 8 Drawing Sheets

(58) Field of Classification Search
USPC ..... 84/609
See application file for complete search history.

(56) References Cited

U.S. PATENT DOCUMENTS

| | | | | |
|---|---|---|---|---|
| 2009/0000462 | A1* | 1/2009 | Fujita | G10H 1/0091 84/604 |
| 2010/0107857 | A1* | 5/2010 | Hasebe | G10H 1/057 84/615 |
| 2012/0137857 | A1* | 6/2012 | Liu | G10H 5/007 84/622 |
| 2015/0371619 | A1* | 12/2015 | Uehara | G10H 1/0553 84/645 |
| 2018/0012572 | A1* | 1/2018 | Yaguchi | G10C 3/16 |
| 2018/0033407 | A1* | 2/2018 | Ohnishi | G10H 1/045 |
| 2018/0233114 | A1* | 8/2018 | Ohba | G10B 3/12 |
| 2018/0233116 | A1* | 8/2018 | Ohba | G10C 3/18 |
| 2018/0322856 | A1* | 11/2018 | Liu | G01P 13/00 |
| 2020/0193949 | A1* | 6/2020 | Tanoue | G10H 1/0575 |
| 2020/0258485 | A1* | 8/2020 | Ota | G10G 3/04 |

FOREIGN PATENT DOCUMENTS

| | | | |
|---|---|---|---|
| JP | H096343 | A | 1/1997 |
| JP | H1074084 | A | 3/1998 |
| JP | 3296156 | B2 | 6/2002 |
| JP | 2009175677 | A | 8/2009 |
| JP | 2010113024 | A | 5/2010 |

OTHER PUBLICATIONS

Written Opinion issued in Intl. Appln. No. PCT/JP2017/033915 dated Nov. 28, 2017.

* cited by examiner

SOUND SIGNAL GENERATION DEVICE, KEYBOARD INSTRUMENT, AND SOUND SIGNAL GENERATION METHOD

CROSS-REFERENCE TO RELATED APPLICATIONS

This application is a U.S. continuation application filed under 35 U.S.C. § 111(a), of International Application No. PCT/JP2017/033915, filed on Sep. 20, 2017, the disclosures of which are incorporated by reference.

FIELD

The present invention relates to a technology of generating a sound signal.

BACKGROUND

In order to make a sound from an electronic piano approach to a sound of an acoustic piano as far as possible, various attempts have been tried. For example, in Patent Literature 1 (Japanese Laid-Open Patent Publication 2010-113024), in order to reflect more an influence of a damper in an acoustic piano on a sound, a technology that performs a release control based on a position of a virtual damper is disclosed.

SUMMARY

According to one embodiment of the present invention, a sound signal generation device is provided, which includes: a memory storing instructions; and a processor that implements the instructions and execute a plurality of tasks, including: a signal generation task that generates a sound signal based on first operation data corresponding to an operation to a key; and an attenuation control task that controls an attenuation velocity of the sound signal to one of a first velocity or a second velocity that is faster than the first velocity, based on the first operation data, and second operation data corresponding to an operation to a pedal, wherein the attenuation control task varies a value of the second velocity based on an operation velocity of the key included in the first operation data to control the attenuation velocity of the sound signal to the second velocity.

According to one embodiment of the present invention, a sound signal generation device is provided, which includes: a memory storing instructions; and a processor that implements the instructions and execute a plurality of tasks, including: a signal generation task that generates a sound signal based on first operation data corresponding to an operation to a key; and an attenuation control task that controls an attenuation velocity of the sound signal to at least one of a first velocity or a second velocity that is faster than the first velocity, based on the first operation data, and second operation data corresponding to an operation to a pedal, wherein the attenuation control task varies a value of the second velocity based on an output level of the sound signal when controlling the attenuation velocity of the sound signal to the second velocity.

According to one embodiment of the present invention, a sound signal generation method is provided, which includes: generating a sound signal based on first operation data corresponding to an operation to a key; and controlling an attenuation velocity of the sound signal to one of a first velocity or a second velocity that is faster than the first velocity, based on the first operation data, and second operation data corresponding to an operation to a pedal, wherein the controlling of the attenuation velocity varies a value of the second velocity based on an operation velocity to the key included in the first operation data to control the attenuation velocity of the sound signal to the second velocity.

According to one embodiment of the present invention, a sound signal generation method is provided, which includes: generating a sound signal based on first operation data corresponding to an operation to a key; and controlling an attenuation velocity of the sound signal to one of at least a first velocity or a second velocity that is faster than the first velocity based on the first operation data and second operation data corresponding to an operation to a pedal, wherein the controlling of the attenuation velocity varies a value of the second velocity based on an output level of the sound signal when controlling the attenuation velocity of the sound signal to the second velocity.

DESCRIPTION OF EMBODIMENTS

Figure 1:
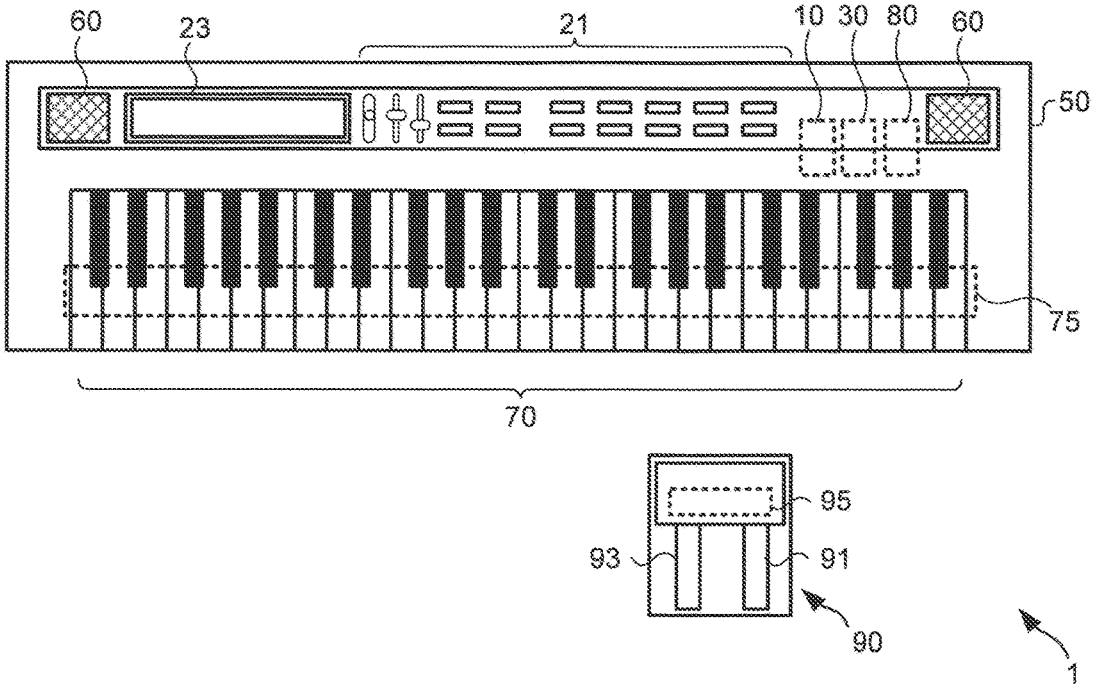
FIG. 1 is a diagram for showing a configuration of a keyboard instrument in a first Embodiment of the present invention.

In what follows, a keyboard instrument in one embodiment of the present invention will be detailed with reference to drawings. An embodiment shown below is only one example of the embodiment of the present invention, and the present invention is not construed by limiting to these embodiments. Furthermore, in the drawings referred in the present embodiments, the same signs or similar signs are imparted to the same parts or parts having the similar function (sign with only A, B or the like attached after the number), and repeated explanation thereof will be omitted in some cases.

First Embodiment

[Configuration of Keyboard Instrument]

FIG. 1 is a diagram for showing a configuration of a keyboard instrument in the first embodiment of the present invention. A keyboard instrument 1 is an electronic keyboard instrument such as an electronic piano and an example of an electronic instrument having a plurality of keys 70 as a performance operator. When a user operates the key 70, a sound is generated from a speaker 60. A kind (tone) of generated sound is varied with an operation unit 21. In this example, the keyboard instrument 1 can, when producing a sound with a tone of a piano, produce a sound which is similar to that produced by an acoustic piano. In particular, the keyboard instrument 1 can, in the performance in a state where a damper pedal is depressed partway (hereinafter, referred to as "half pedal") with a half pedal, produce a sound by more accurately reflecting an influence of a damper.

According to the technology disclosed in the Patent Literature 1, a performance with a half pedal may be reproduced. The half pedal is used in some case in a performance reproduction that emphasizes a melody while leaving an effect of the damper pedal. When the performance like this is performed, there is a case where the difference from the performance by the acoustic piano is generated.

According to the present invention, a processing capable of more accurately reflecting an influence of a damper of an acoustic piano in a specific performance may be provided. Subsequently, each of configurations of the keyboard instrument 1 will be detailed.

The keyboard instrument 1 includes a plurality of keys 70, a chassis 50 and a pedal device 90. The plurality of keys 70 are rotatably supported by the chassis 50. In the chassis 50, an operation unit 21, a display unit 23, and a speaker 60 are arranged. In the inside of the chassis 50, a control unit 10, a memory unit 30, a key behavior measurement unit 75 and a sound source unit 80 are arranged. The pedal device 90 is provided with a damper pedal 91, a shift pedal 93 and a pedal behavior measurement unit 95. The respective configurations arranged inside of the chassis 50 are connected via a bus.

In this example, the keyboard instrument 1 includes an external device and an interface for inputting and outputting a signal. Examples of the interface include a terminal for outputting the sound signal and a cable connection terminal for transmitting and receiving the MIDI data. In the example, by connecting the pedal device 90 to the interface, the pedal behavior measurement unit 95 is connected with the respective configurations arranged inside of the chassis 50 via the bus.

The control unit 10 includes an arithmetic processing circuit such as a CPU and a memory device such as a RAM or a ROM. The control unit 10 executes a control program memorized in the memory unit 30 with the CPU to make various kinds of functions realize in the keyboard instrument 1. The operation unit 21 is a device such as an operation button, a touch sensor and a slider, and outputs a signal corresponding the inputted operation to the control unit 10. The display unit 23 displays a screen based on the control due to the control unit 10.

The memory unit 30 is a memory device such as a nonvolatile memory. The memory unit 30 memorizes a control program executed by the control unit 10. Furthermore, the memory unit 30 may memorize a parameter and waveform data used in the sound source unit 80. The speaker 60 amplifies a sound signal output from the control unit 10 or the sound source unit 80 and outputs to generate a sound corresponding to the sound signal.

The key behavior measurement unit 75 measures each of behaviors of the plurality of keys 70 and outputs measurement data showing measurement results. The measurement data includes information (KC, KS, KV). That is, corresponding to a depressed operation to each of the plurality of keys 70, the information (KC, KS, KV) is output. The information KC is information (for example, key number) showing an operated key 70. The information KS is information showing a depressed amount of the key 70. The information KV is information showing a depressed velocity of the key 70. When the information KC, KS, KV is associated and output, an operated key 70 and an operation content to the key 70 are specified.

The pedal behavior measurement unit 95 measures a behavior of each of the damper pedal 91 and the shift pedal 93 and outputs measurement data showing measurement results. The measurement data includes information (PC, PS). The information PC is information showing whether the operated pedal is the damper pedal 91 or the shift pedal 93. The information PS is information showing a depressed amount of the pedal. When the information PC and PS is associated and output, the operated pedal (damper pedal 91 or the shift pedal 93) and an operation content (depressed amount) to the pedal may be specified. Furthermore, when a pedal of the pedal device 90 is only the damper pedal 91, the information PC is not necessary.

The sound source unit 80 generates a sound signal based on information input from the key behavior measurement unit 75 and the pedal behavior measurement unit 95 and outputs to the speaker 60. A sound signal generated by the sound source unit 80 is obtained for every operation to the key 70. Then, a plurality of sound signals obtained by the plurality of key depression are synthesized and output from the sound source unit 80. A configuration of the sound source unit 80 will be detailed.

[Configuration of Sound Source Unit]

Figure 2:
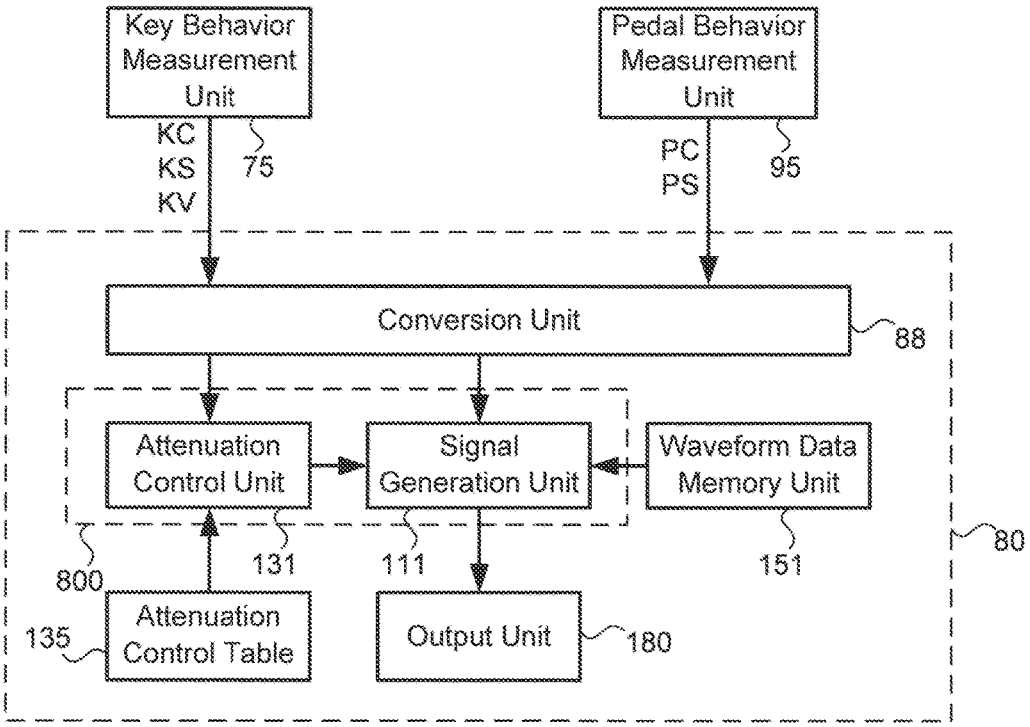
FIG. 2 is a block diagram for showing a functional configuration of a sound source unit in the first embodiment of the present invention.

FIG. 2 is a diagram for showing a functional configuration of a sound source unit in a first embodiment of the present invention. The sound source unit 80 includes a conversion unit 88, a sound signal generation unit 800 (a sound signal generation device), an attenuation control table 135, a waveform data memory unit 151 and an output unit 180. The sound signal generation unit 800 includes a signal generation unit 111 and an attenuation control unit 131.

The conversion unit 88 converts information (KC, KS, KV, PC, PS) to be input into control data of a format used in the sound signal generation unit 800. Namely, information having mutually different meanings is converted into the control data of a common format. The control data is data defining a content of sound production. In the example, the conversion unit 88 converts information input to control data of the MIDI form. The conversion unit 88 outputs generated control data to the sound signal generation unit 800 (a signal generation unit 111 and an attenuation control unit 131).

The conversion unit 88 generates control data (hereinafter, referred to as first operation data) corresponding to an operation to the key 70, based on the information (KC, KS, KV) inputted from the key behavior measurement unit 75. In this example, the first operation data includes information (note number) showing a position of the operated key 70, information (note on) showing that the key is depressed, and information (note off) showing that the key is released and an operation velocity to the key 70, namely, a key depressing velocity (velocity: 0 to 127 in this example). Thus, the conversion unit 88 functions also as a first operation data generation unit generating first operation data.

Furthermore, the conversion unit 88 generates control data (hereinafter, referred to as the second operation data) corresponding to an operation (depressed amount) of the damper pedal 91 based on the information (PC, PS) inputted from the pedal behavior measurement unit 95. The second operation data includes information (damper-on) showing that the damper goes-up completely in the acoustic piano (the pedal is at an end position), information (damper-off) showing that the damper goes-down completely (the pedal is at an end position), and information (half-damper) showing being in a state (half pedal) where the damper is at an intermediate position excluding the rest position and the end position. Furthermore, the pedal can be operated in the range from the rest position and the end position.

In this example, the damper-on corresponds not only to a state (a state where the damper pedal 91 is at an end position) where the damper completely goes-up but also corresponds to a state where the damper pedal 91 is located in a predetermined range from the end position (set in advance to be identical as the state). The damper-off corresponds not only to a state (a state where the damper pedal 91 is at a rest position) where the damper completely goes-down but also corresponds to a state where the damper pedal 91 is located in a predetermined range from the rest position (set in advance to be identical as the state). Thus, the conversion unit 88 functions also as a second operation data generation unit generating the second operation data. Furthermore, although control data corresponding to the shift pedal 93 may be generated, here, the explanation thereof will be omitted.

The conversion unit 88 outputs the generated control data to the sound signal generation unit 800 (signal generation unit 111 and attenuation control unit 131). Specifically, the conversion unit 88 outputs the first operation data to the signal generation unit 111 and the attenuation control unit 131, and outputs the second operation data to the attenuation control unit 131.

The waveform data memory unit 151 memorizes at least, piano sound waveform data. The piano sound waveform data is waveform data obtained by sampling a sound of the acoustic piano (sound generated by striking a string accompanying key depression).

The signal generation unit 111 generates a sound signal based on the first operation data inputted from the conversion unit 88 and outputs. At this time, the attenuation control unit 131 adjusts an envelope of the sound signal.

The attenuation control unit 131 controls the envelope of the sound signal generated in the signal generation unit 111, based on the first operation data and the second operation data inputted from the conversion unit 88 with reference to the attenuation control table 135. Especially, the envelope when the sound signal attenuates is controlled. In this example, the attenuation control unit 131 controls the attenuation velocity based on the operation of the damper pedal 91 (namely, second operation data), in particular, when the operation of the half pedal is executed, the attenuation velocity is furthermore controlled based on the velocity in the first operation data.

The attenuation control table 135 is a table that defines a relation between the velocity and an attenuation coefficient k at the time of the half pedal. The attenuation coefficient k is a coefficient showing a ratio that varies to the attenuation velocity at the time of damper-on. In this example, the attenuation coefficient k is a value equal to or larger than 1. The case of k=1 means the attenuation velocity that does not vary from a preset value (decay rate DR). On the other hand, as the k becomes larger than 1, it is meant that the attenuation velocity of the sound signal is sped-up. Furthermore, the detail of the relation defined by the attenuation control table 135 and the attenuation coefficient k will be described later.

The output unit 180 outputs the sound signal generated by the signal generation unit 111 outside of the sound source unit 80. In this example, the sound signal is output to the speaker 60 and heard by a user. Subsequently, the detailed configuration of the signal generation unit 111 will be described.

[Configuration of Signal Generation Unit]

Figure 3:
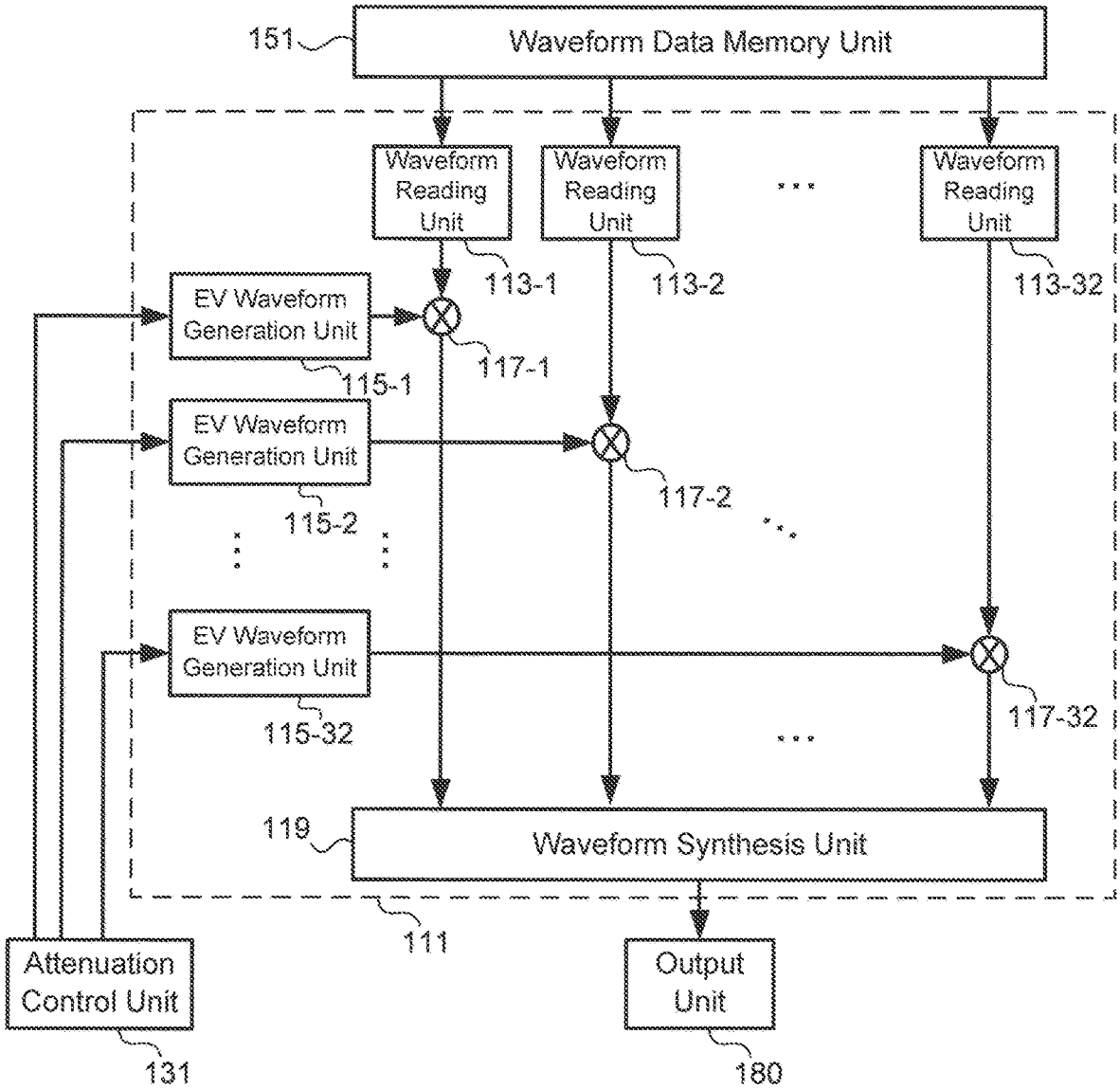
FIG. 3 is a block diagram for showing a functional configuration of a signal generation unit in the first embodiment of the present invention.

FIG. 3 is a block diagram for showing a functional configuration of a signal generation unit in the first embodiment of the present invention. The signal generation unit 111 includes waveform reading units 113 (waveform reading unit 113-1, 113-2, . . . , **113-*n*), EV (envelope) waveform generation units 115 (115-1, 115-2, . . . , 115-*n*), multipliers 117 (117-1, 117-2, . . . , 117-*n*) and a waveform synthesis unit 119. The "n" corresponds to the number of sounds that can be simultaneously produced (the number of the sound signals that can be generated simultaneously) and is 32 in the example. Namely, according to the signal generation unit 111**, a state of production of sounds is maintained up to 32 key depression, and when the 33rd key depression is applied, the sound signal corresponding to the first produced sound is forcibly stopped.

The waveform reading unit 113-1 reads by selecting waveform data to be read from the waveform data memory unit 151 based on the first operation data obtained from the conversion unit 88, and generates a sound signal of a pitch corresponding to the note number. In the example, piano sound waveform data is read. The EV waveform generation unit 115-1 generates an envelope waveform based on the first operation data obtained from the conversion unit 88 and a preset parameter. The envelope waveform to be generated is partially adjusted by the attenuation control unit 131. A generation method and its adjustment method of the envelope waveform will be described later. The multiplier 117-1 multiplies the envelope waveform generated in the EV waveform generation unit 115-1 on the sound signal generated in the waveform reading unit 113-1.

Although a case of n=1 is illustrated, every time when a next key is depressed during a sound signal is output from the multiplier 117-1, the first operation data corresponding to the key depression is applied in an order of n=2, 3, 4 . . . . For example, in the case of next key depression, the first operation data is applied to a configuration of n=2, and the sound signal is output from the multiplier 117-2 in the same manner as the above. The waveform synthesis unit 119 synthesizes sound signals output from the multipliers 117-1, 117-2, . . . , 117-32 and outputs to the output unit 180.

[Envelope Wave Form]

The envelope waveform generated in the EV waveform generation unit 115 will be described. First, a general envelope waveform and a parameter will be described.

Figure 4:
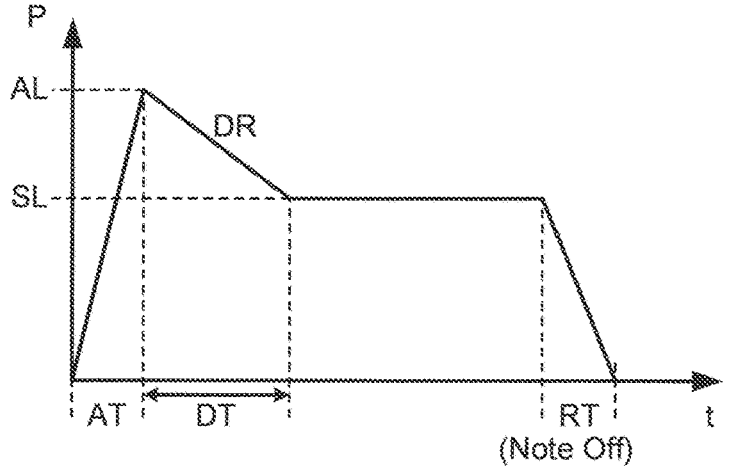
FIG. 4 is a diagram for explaining a definition of a general envelope waveform.

FIG. 4 is a diagram for explaining a definition of a general envelope waveform. As shown in FIG. 4, the envelope waveform is defined with a plurality of parameters. The plurality of parameters include an attack level AL, an attack time AT, a decay time DT, a sustain level SL and a release time RT. Furthermore, the attack level AL may be fixed to a maximum value (for example 127). In this case, the sustain level SL is set in the range of 0 to 127.

If the note-on occurs, the envelope waveform increases up to the attack level AL at a time of the attack time AT. After that, the envelope waveform decreases to the sustain level SL at a time of the decay time DT, and the sustain level SL is maintained. If the note-off occurs, the envelope waveform decreases from the sustain level SL to a mute state (level "0") at a time of the release time RT. Before reaching to the sustain level SL, namely, in a period of attack time AT and in a period of the decay time DT, if the note-off occurs, in a time of the release time RT from its point of time, a mute state is reached. Furthermore, by an attenuation rate obtained by dividing the sustain level SL with the release time RT, a mute state may be reached.

A decay rate DR is a value calculated from the parameter described above and is obtained by dividing a difference between the attack level AL and the sustain level SL by the decay time DT. This parameter (decay rate DR) shows a degree (attenuation velocity) of a natural attenuation of a sound in a decay period after the note-on. Furthermore, although an example where the attenuation velocity of the decay rate DR is constant (gradient is straight line) in the decay period is exemplified, it is not necessarily to be constant. Namely, when the attenuation velocity shows a predetermined variation, the gradient may be defined with other than a straight line.

Figure 5:
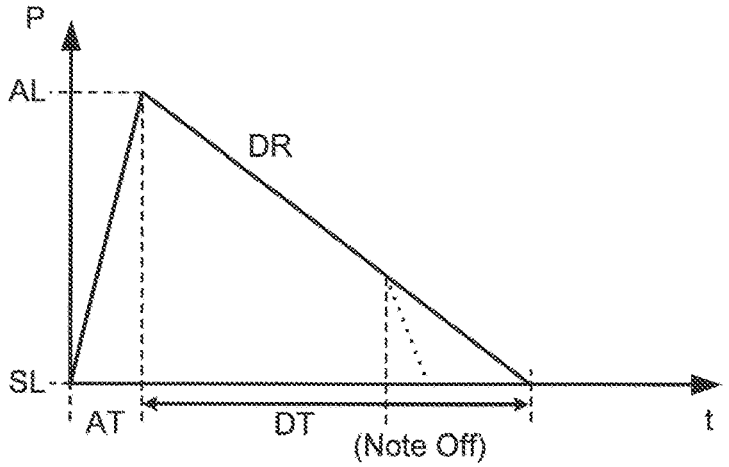
FIG. 5 is a diagram for explaining an example of an envelope waveform of a sound of a piano.

FIG. 5 is a diagram for explaining an example of an envelope waveform of a sound of a piano. In a sound of a general piano, for example, the sustain level SL is set to "0", and the decay time DT is set relatively longer (the decay rate DR is small). This state shows a state where the damper is detached from a string (damper-on). When the note-off occurs in the decay time DT, the damper comes into contact with the string (damper-off), according to the setting of the release time RT, the envelope waveform rapidly attenuates as shown with a dotted line. The EV waveform generation unit 115 in this example generates an envelope waveform shown in FIG. 5, and the decay rate DR is adjusted by the attenuation control unit 131. For example, in the case of half damper, the attenuation control unit 131, while controlling the decay rate DR (attenuation velocity) faster than when the damper-on occurs, controls slower than the attenuation velocity when the damper-off is present.

These parameters are explained as preset values that define the envelope waveform and the respective levels such as the attack level AL and so on are relative values. Accordingly, the envelope waveform output from the EV waveform generation unit 115, namely, in the envelope waveform multiplied on the sound signal in the multiplier 117, an absolute value of the output level is adjusted corresponding to the velocity. Furthermore, the output level adjustment may be realized by an amplification circuit.

The attenuation control unit 131 adjusts the decay rate DR based on the velocity (key depressing velocity of the key 70) corresponding to each of sounds in the time of half-damper. As is described above, as the parameter relating the adjustment of the attenuation velocity, the attenuation coefficient k is used. In this example, when the decay rate after adjustment is set to DRf, it is calculated as DRf=DR×k. Namely, the larger becomes the attenuation coefficient k, the faster the attenuation velocity is. Like this, the control for adjusting the attenuation velocity will be described. First, the attenuation control table 135 referred to by the attenuation control unit 131 will be described.

[Attenuation Control Table]

Figure 6:
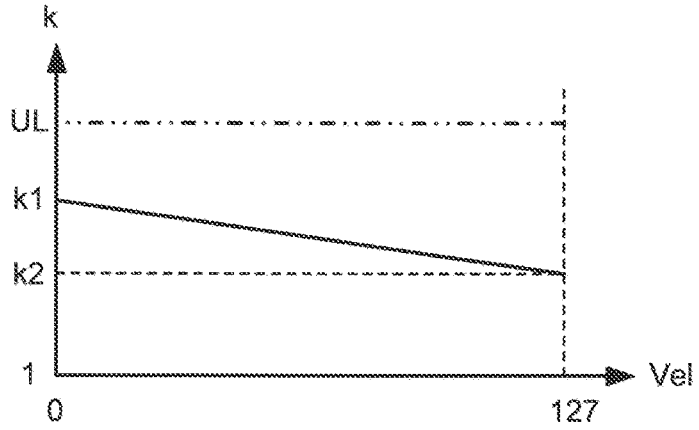
FIG. 6 is a diagram for explaining a relation between an attenuation coefficient and a velocity which are defined in an attenuation control table in the first embodiment of the present invention.

FIG. 6 is a diagram for explaining a relation between an attenuation coefficient and a velocity which are defined in an attenuation control table in the first embodiment of the present invention. The velocity (Vel) is shown on a horizontal axis and the attenuation coefficient k is shown on a vertical axis. The attenuation coefficient k is set to 1 or larger and less than UL. The UL is a value corresponding to the attenuation velocity after the note-off.

The attenuation velocity (first velocity) when the attenuation coefficient is k=1 corresponds to the decay rate DR, and corresponds to the attenuation velocity in a state of the note-on (key depression), and the attenuation velocity in a state of the damper-on. On the other hand, the attenuation velocity when the attenuation coefficient is k=UL corresponds to the attenuation velocity after the note-off (and damper-off). In an example of the attenuation control table 135 shown in FIG. 6, the attenuation coefficient k is defined such that it becomes a maximum value k1 when the velocity is a minimum value "0", and, as the velocity increases, decreases monotonically at a constant ratio to be a minimum value k2 when the velocity is a maximum value "127".

The attenuation control unit 131 controls such that the attenuation velocity (second velocity) of each sound at the time of half-damper, namely, the decay rate DRf is adjusted in the range of from DR×k1 to DR×k2 corresponding to the velocity (key depressing velocity) corresponding to each sound by referencing this attenuation control table 135. Subsequently, an attenuation control processing due to the attenuation control unit 131 will be described.

[Attenuation Control Processing]

Figure 7:
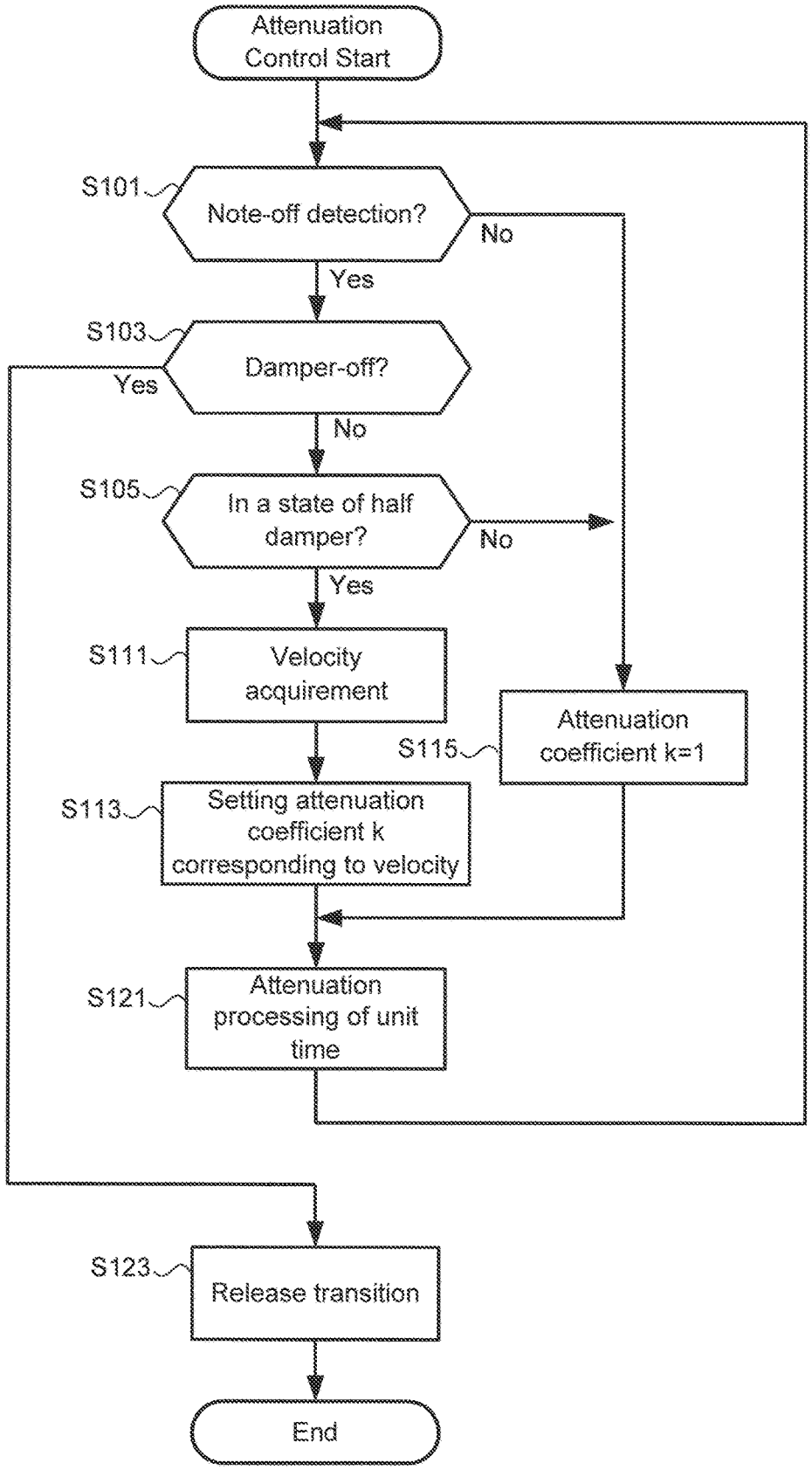
FIG. 7 is a flow chart for showing an attenuation control processing in the first embodiment of the present invention.

FIG. 7 is a flow chart for showing an attenuation control processing in the first embodiment of the present invention. The attenuation control processing is executed corresponding to each note-on when the note-on is detected by the first operation data and a waveform data is read (in more detail, when reaching the decay period). Therefore, as shown in FIG. 3, when the number of sounds that can be simultaneously produced is 32, the attenuation control processing of maximum 32 are executed in parallel.

First, the attenuation control unit 131 determines, during from the former determination to this time determination, whether the note-off is detected based on the first operation data (step S101), and whether it is in a state of the damper-off based on the second operation data (step S103). When the note-off is not detected (step S101, No), since it corresponds to a state of key depression, irrespective of the state of the damper pedal, the attenuation coefficient k=1 is set (step S115). Namely, the attenuation velocity is set to just as the usual decay rate DRf (=DR×1). The attenuation control unit 131 executes the attenuation processing of unit time (step S121) and repeats the processing after returning once more to the step S101. The unit time is a time corresponding to a predetermined processing unit, for example, corresponds to a processing time at 1 clock.

Subsequently, in the case where the note-off is detected (step S101, Yes) and in the case of a state of the damper-off (step S103; Yes), since it corresponds to a state where the damper pedal 91 is not operated and a state of key releasing, the step moves to the release (step S123) to end the attenuation control processing. Namely, the attenuation control unit 131 controls so as to switch from the attenuation velocity at the decay rate DRf to the attenuation velocity corresponding to the release period.

On the other hand, in the case where the note-off is detected (step S101, Yes) and in the case of not in the state of damper-off (step S103; No), whether it is in a state of the half damper is determined based on the second operation data (step S105). In the case of not in a state of the half-damper (step S105; No), because of a state of the damper-on, even the key is released, in the same manner as a state where the key is depressed, the attenuation control unit 131 sets to the attenuation coefficient k=1 (step S115).

In the case of the state of half-damper (step S105; Yes), the attenuation control unit 131 acquires the velocity of the note number corresponding to the processing based on the first operation data (step S111), and sets the attenuation coefficient k corresponding to the velocity (step S113). The attenuation coefficient k corresponding to the velocity is set according to the attenuation control table 135. Namely, as is described above, the larger the velocity becomes, the smaller the attenuation velocity k is. Then, the attenuation control unit 131 executes the attenuation processing of unit time due to the decay rate DRf (DR×k) determined by the preset attenuation coefficient k (step S121), and returns once more to the step S101 to repeat the processing.

According to the attenuation control processing like this, in a state of the half-damper, the attenuation velocity is controlled to be faster than the state of the damper-on (and the state of note-on). Furthermore, the attenuation velocity at the time of half-damper is controlled such that the smaller the key depressing velocity of the sound is, the faster the attenuation velocity becomes. By performing the attenuation control like this, the attenuation of the sound when the half-pedal is operated in an acoustic piano can be more accurately reproduced. Details are as shown below.

In the performance of an acoustic piano, when the half-pedal is operated, a resonance of an appropriate length of producing a sound can be obtained, therefore, the half pedal operation is used to produce a sound while resonating a melody. At this time, the effectiveness of the damper to each sound is not necessarily constant. For example, a string having small sound has a small vibration energy, the velocity that attenuates under an influence of the damper is faster than a string having a large sound. Thus, it can be suppressed that a sound that is not important remains when resonating a melody to leave unnatural reverberation.

According to an electronic piano that controls the attenuation velocity constant irrespective of a performance state when the half pedal is operated, since it does not consider the difference of the effectiveness of the damper like this, the resonance is uniform. Therefore, depending on a content of the performance, the unnatural reverberation remains, and in some cases, the performance expression that makes the melody accentuate is difficult. On the other hand, according to the keyboard instrument due to the present invention, as is described above, the attenuation velocity when the half-pedal is operated can be varied corresponding to the key depressing velocity. By making the resonance of the large sound longer and by making the resonance of the small sound shorter, an influence of the damper when the half-pedal in an acoustic piano is operated can be more accurately reflected.

Second Embodiment

Although in the first embodiment, corresponding to the key depressing velocity when the half-pedal is operated, the attenuation velocity of each sound is varied, in the second embodiment, a keyboard instrument in which corresponding to a magnitude of each sound when the half-pedal is operated, the attenuation velocity of each sound is varied will be described. In the following description, among configurations in the second embodiment, explanations of the configurations the similar as the first embodiment will be omitted. Furthermore, in the second embodiment, compared with the case of the first embodiment, a signal generation unit, an attenuation control unit and an attenuation control table are different.

Figure 8:
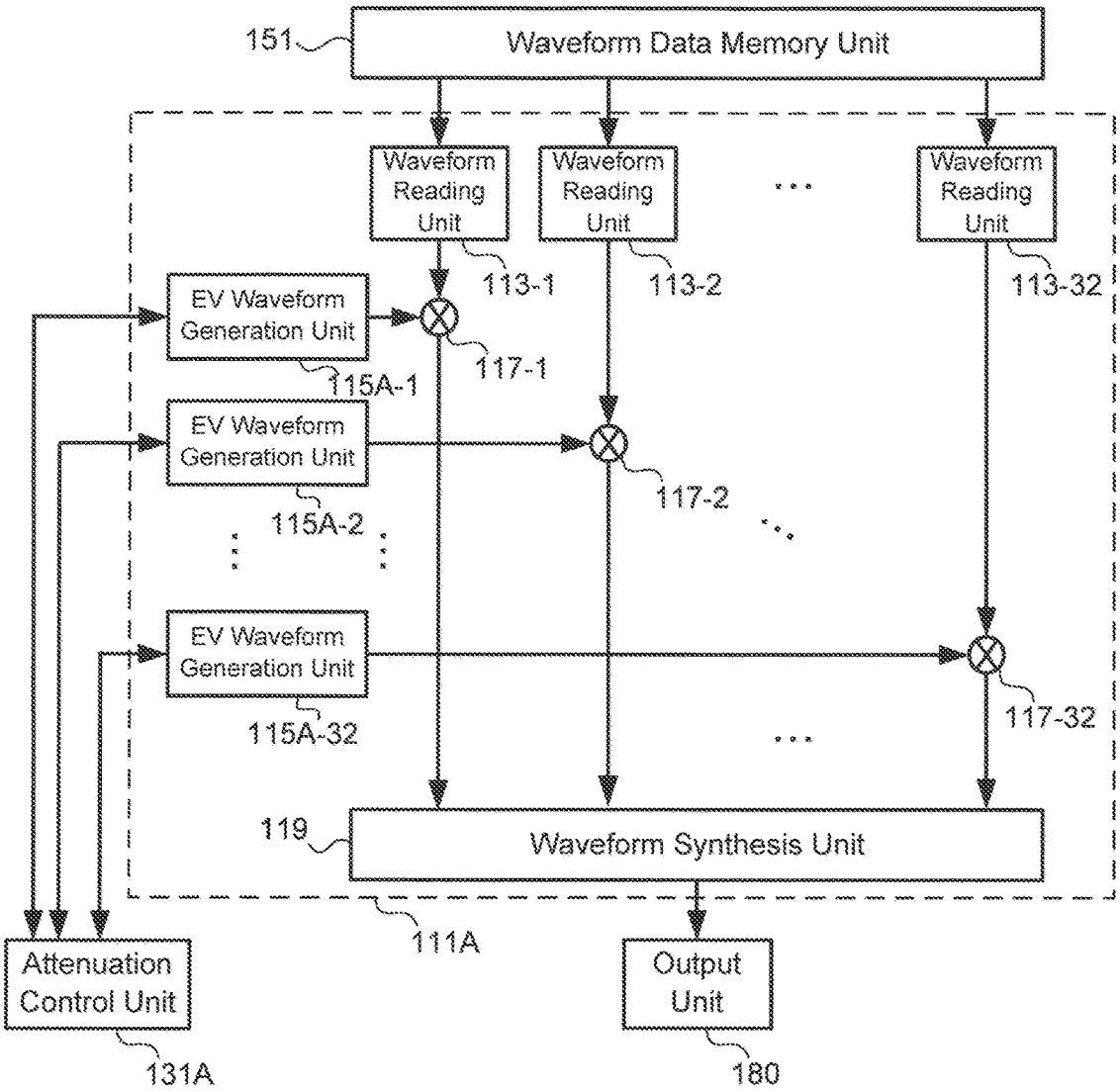
FIG. 8 is a block diagram for showing a functional configuration of a sound generation unit in a second embodiment of the present invention.

FIG. 8 is a block diagram for showing a functional configuration of a sound signal generation unit in a second embodiment of the present invention. In the signal generation unit 111A in the second embodiment, an EV waveform generation unit 115A (115A-1, 115A-2, . . . , 115A-*n*) is different from the first embodiment. The EV waveform generation unit 115A outputs an output level of an envelope waveform outputted to a multiplier 117 to an attenuation control unit 131A. The attenuation control unit 131A adjusts, in the time of half damper, a decay rate DR based on an output level (sound volume) of a sound signal corresponding to each sound. The attenuation control unit 131A adjusts, in the same manner as the first embodiment, the decay rate DR by setting the attenuation coefficient k by referencing the attenuation control table.

Figure 9:
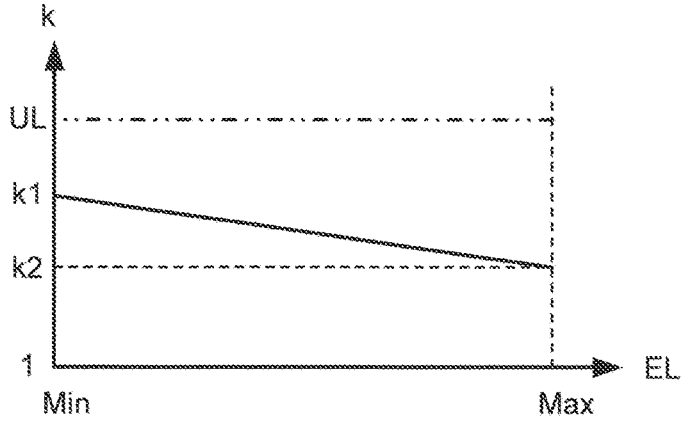
FIG. 9 is a diagram for explaining a relation between the attenuation coefficient and an output level which are defined in an attenuation control table in the second embodiment of the present invention.

FIG. 9 is a diagram for explaining a relation between the attenuation coefficient and an output level which are defined in an attenuation control table in the second embodiment of the present invention. An output level (EL) is shown on a horizontal axis, and an attenuation coefficient k is shown on a vertical axis. In an example of the attenuation control table shown in FIG. 9, the attenuation coefficient k is defined such that it becomes a maximum value k1 when the output level is a minimum value "Min", as the output level increases, decreases monotonically at a constant rate, and becomes a minimum value k2 when the output level is the maximum value "Max".

The attenuation control unit 131A controls such that the decay rate DRf of each sound at the time of the half-damper is adjusted in the range from DR×k1 to DR×k2 corresponding to an output level (sound volume) corresponding to each sound by referencing the attenuation control table. Subsequently, the attenuation control processing due to the attenuation control unit 131A will be described.

Figure 10:
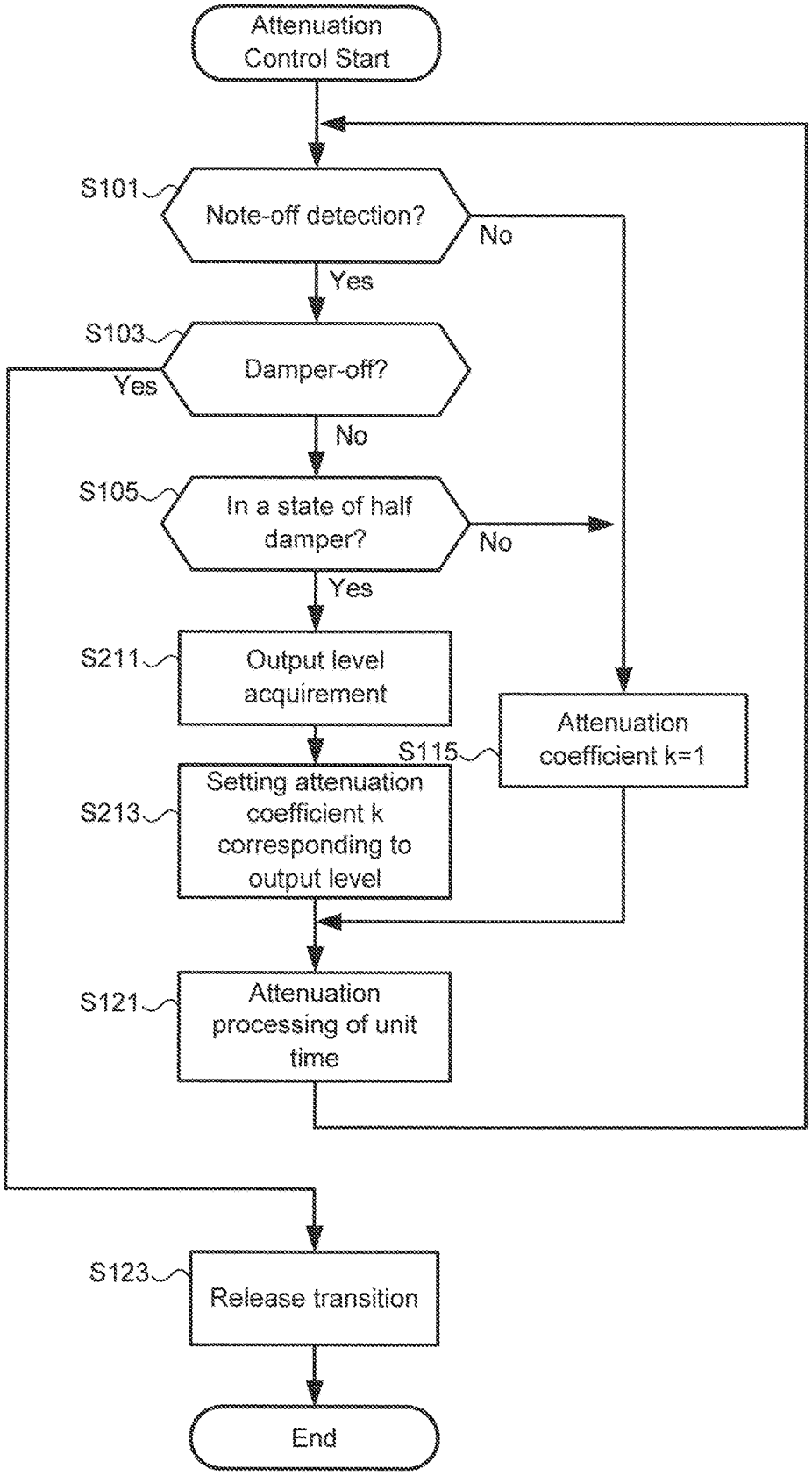
FIG. 10 is a flow chart for showing the attenuation control processing in the second embodiment of the present invention.

FIG. 10 is a flow chart for showing the attenuation control processing in the second embodiment of the present invention. The attenuation control processing in the second embodiment is different in a point of executing the processing of step S211 and S213 in place of the step S111 and S113 in the first embodiment. In the attenuation control processing in the second embodiment, since the processing other than the above are the same processing as the first embodiment, the description will be omitted. In the attenuation control processing in the second embodiment, in the case of being in a state of half-damper (step S105; Yes), the attenuation control unit 131A acquires the output level of the sound corresponding to the processing from a corresponding EV waveform generation unit 115A (step S211), and the attenuation coefficient k corresponding to the output level is set (step S213). Furthermore, the output level may be the output level before a predetermined time from the time of detecting a state of the half-damper without limiting to the output level at the time of detecting a state of the half-damper.

The attenuation coefficient k corresponding to the output level is set, as is described above, such that the larger the output level becomes, the smaller the attenuation coefficient k is. Thus, without limiting to a case where the attenuation velocity of each sound is controlled by the key depressing velocity like in the first embodiment but may be controlled by an output level when the half-pedal is operated like the second embodiment.

Third Embodiment

Although the attenuation velocity of each sound when the half-pedal is operated is controlled by varying the envelop waveform (especially decay rate) in the first embodiment and the second embodiment, a keyboard instrument in which a degree of reverberation added is controlled to control the attenuation velocity of each sound will be described in the third embodiment. Furthermore, in the third embodiment, compared with the case of the first embodiment, the signal generation unit and the attenuation control unit are different.

Figure 11:
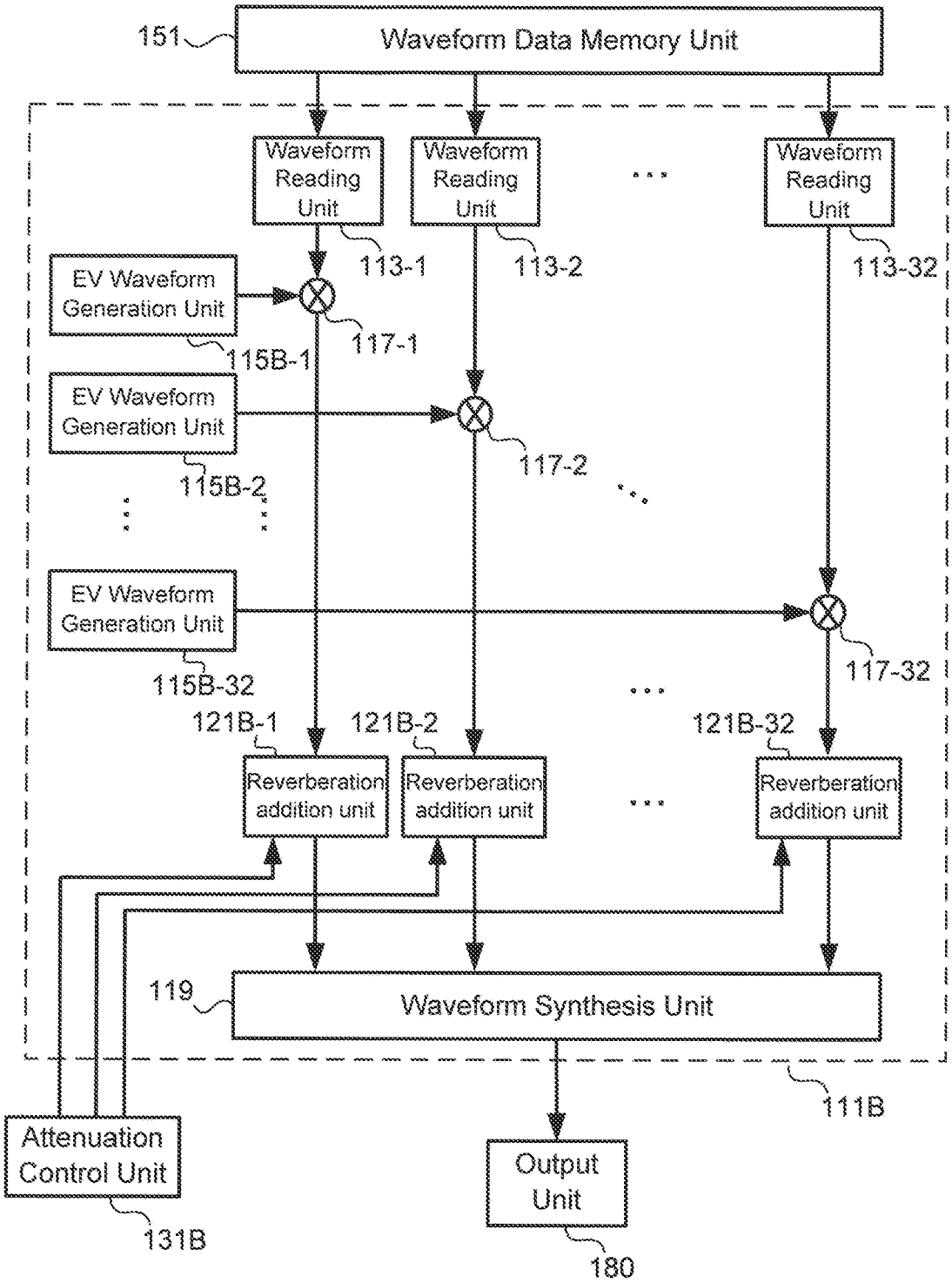
FIG. 11 is a block diagram for showing a functional configuration of a sound signal generation unit in a third embodiment of the present invention.

FIG. 11 is a block diagram for showing a functional configuration of a sound generation unit in the third embodiment of the present invention. In a signal generation unit 111B in the third embodiment, an EV waveform generation unit 115B (115B-1, 115B-2, 115B-*n*) is different from the first embodiment. In this example, the EV waveform generation unit 115B is formed so as not to receive the adjustment of the envelop waveform from an attenuation control unit 131B. Namely, to the multiplier 117, an envelope waveform corresponding to a preset parameter is output. On the other hand, the signal generation unit 111B includes a reverberation addition unit 121B (121B-1, 121B-2, 121B-*n*) that receives a control from the attenuation control unit 113B. Although the attenuation control unit 131B carries out the processing the same as the attenuation control unit 131 in the first embodiment, it is different in a point that the EV wave form generation unit 115 is not controlled based on the attenuation coefficient k but the reverberation addition unit 121B is controlled.

The reverberation addition unit 121B is inserted between the multiplier 117 and the waveform synthesis unit 119. For example, the reverberation addition unit 121B-1 is provided between the multiplier 117-1 and the waveform synthesis unit 119. The reverberation such as reverb used in a general effect control is added to a sound signal synthesized by the waveform synthesis unit 119. On the other hand, in this example, the reverberation is individually added to each sound. The reverberation addition unit 121B may adopt also any known configuration as long as it is a configuration capable of changing a reverberation time while adding the reverberation, for example, it can be realized by a comb filter that uses the feedback delay. A technology disclosed in Japanese Patent No. 3296156 may be used.

A time of the reverberation added in the reverberation addition unit 121B is controlled by the attenuation control unit 131B. For example, when the comb filter illustrated above is used, the attenuation control unit 131B can adjust a length of a reverberation time to the sound signal by changing a feedback gain corresponding to the attenuation coefficient k. The attenuation control unit 131B controls such that as the attenuation coefficient k becomes larger, the feedback gain is made smaller and the attenuation velocity becomes faster. For example, a reciprocal number of the attenuation coefficient k may be set as the feedback gain.

Thus, the attenuation velocity of each sound may be controlled corresponding to the key depressing velocity by adjusting the reverberation time in the reverberation addition unit 121B in place of adjusting the envelope waveform like the first embodiment. Furthermore, by using the adjustment of the reverberation time and the adjustment of the envelope waveform in combination, the attenuation velocity of each sound may be controlled. In the same manner as the second embodiment, the attenuation velocity may be controlled by adjusting the reverberation time of each sound corresponding to the sound volume.

Fourth Embodiment

In the embodiment describe above, for example, in the first embodiment, although the attenuation control unit 131 controls the attenuation velocity by the attenuation coefficient k set corresponding to the velocity, the attenuation velocity may be controlled by using the attenuation coefficient set corresponding to a further separate parameter in combination. In the fourth embodiment, an example of using a second attenuation coefficient kp set corresponding to the note number (pitch) corresponding to each sound will be described. Furthermore, in the same manner as the case of applying in the second and third embodiments, explanation will be omitted.

Figure 12:
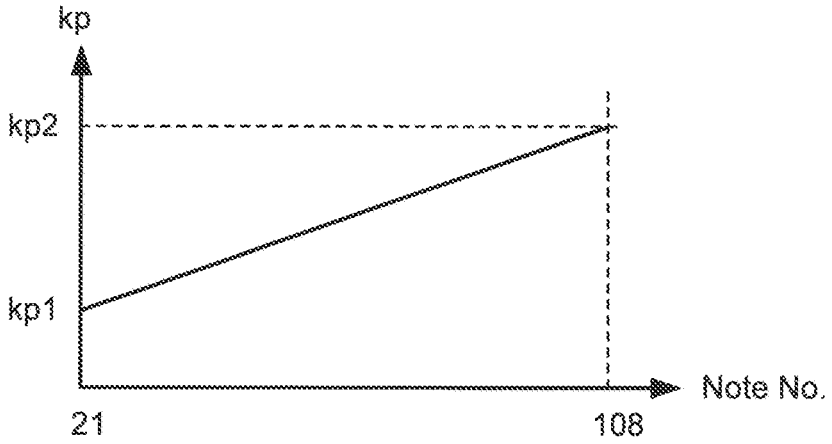
FIG. 12 is a diagram for explaining a relation between a second attenuation coefficient and note number which are defined in an attenuation control table in a fourth embodiment of the present invention.

FIG. 12 is a diagram for explaining a relation between a second attenuation coefficient and note number which are defined in an attenuation control table in a fourth embodiment of the present invention. The note number (Note No.) is shown on a horizontal axis, and the second attenuation coefficient kp is shown on a vertical axis. In this example, the second attenuation coefficient kp becomes a minimum value kp1 when the note number is "21", and becomes a maximum value kp2 when the note number is "108". Furthermore, the range of the note number shows an example when a piano having 88 keys is assumed. According to the attenuation control table shown in FIG. 12, the second attenuation coefficient that makes the attenuation velocity faster as the pitch becomes higher is defined. Furthermore, without limiting to a case where a different second attenuation coefficient kp is set for every note number, by dividing into predetermined sound ranges, the second attenuation coefficient may be step-wisely defined. For example, the range of the pitch where the kinds or the number of the string is same may be defined to be the same second attenuation coefficient kp.

The second attenuation coefficient kp is used as a factor multiplied on the attenuation coefficient k. For example, when used to adjust the decay rate DR in the first embodiment, the decay rate DRf is set as DR×k×kp. By setting the attenuation velocity like this, the effectiveness of the damper caused by the difference of the string to the pitch (kind, number of strings, tension) and the difference of the damper (felt shape, structure) to the pitch can be reflected also on the attenuation velocity.

Fifth Embodiment

Although the state of the half-damper is one in the first embodiment, corresponding to an operation amount to the damper pedal 91, a plurality of states of the half-damper may be taken. In the fifth embodiment, a case where the state of the half-damper is two will be described. In this example, an explanation will be given by assuming that there are a state of the first half-damper where an operation amount to the damper pedal 91 is large and an influence to the string is small, and a state of the second half-damper where an operation amount is small than the above and an influence to the string is large. Furthermore, in the same manner as applied to the second and third embodiments, explanation will be omitted.

Figure 13:
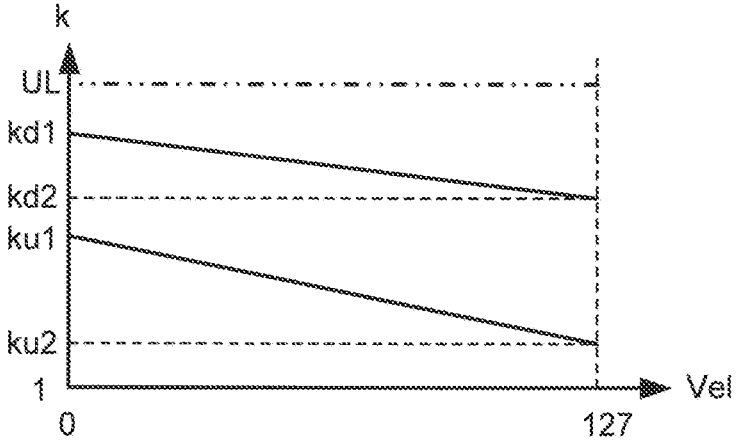
FIG. 13 is a diagram for explaining a relation between an attenuation coefficient and the velocity which are defined in an attenuation control table in a fifth embodiment of the present invention.

FIG. 13 is a diagram for explaining a relation between an attenuation coefficient and the velocity which are defined in an attenuation control table in a fifth embodiment of the present invention. Although the attenuation control table shown in FIG. 13 is the same in the relation of a vertical axis and a horizontal axis as the attenuation control table shown in the first embodiment, the attenuation coefficient k is defined with a value different between the case of the first half-damper and the case of the second half-damper. Namely, the attenuation velocity (third velocity) at the time of the first half-damper and the attenuation velocity at the time of the second half-damper (second velocity) are different.

First, in the case of the first half-damper, when the velocity is a minimum value "0", a maximum value ku1 is taken, and as the velocity increases, the k is defined such that it monotonically decreases at a constant rate, and at the time where the velocity is a maximum value "127", a minimum value ku2 is taken. On the other hand, in the case of the second half-damper, it is defined such that a maximum value kd1 (>ku1) is reached when the velocity is a minimum value "0", and, as the velocity increases, the k monotonically decreases at a constant ratio, and when the velocity is a maximum value "127", a minimum value kd2 (>ku2) is reached. Furthermore, in this example, although the relation of kd2>ku1 is satisfied, but the relation may not be satisfied.

Furthermore, in the example shown in FIG. 13, an amount of change "ku1−ku2" of the attenuation coefficient in the case of the first half-damper is larger than an amount of change of "kd1−kd2" of the attenuation coefficient of the second half-damper. This shows that the smaller the effectiveness of the damper to the string is, the larger an influence giving on a change of the attenuation velocity due to the difference of the key depressing velocity becomes. Thus, by dividing the state of the damper into a plurality of stages, finely controls the effectiveness of the damper to the string, furthermore, the attenuation velocity may be varied due to the key depressing velocity. At this time, as a division where the attenuation coefficient becomes smaller, the amount of change of the attenuation coefficient due to the difference of the key depressing velocity may be made larger. Thereby, an influence of the damper when the half-pedal is operated may be more accurately reflected.

Modification Example

In the above, although one embodiment of the present invention is described, an embodiment in which each of the embodiments is combined with each other or substituted with each other may be adopted. Furthermore, one embodiment of the present invention may be modified into various aspects as shown below. Still furthermore, modification examples described below may be combined with each other and applied.

(1) In the above-described embodiments, the relation between the attenuation coefficient k defined in the attenuation control table and each parameter is defined with an object of more accurately reproducing the relation between a string and a damper of an acoustic piano. For example, in the first embodiment, the attenuation coefficient k is defined so as to decrease at a constant rate as the velocity increases. On the other hand, the relation defined in the attenuation control table may be appropriately set corresponding to an effect to be aimed. For example, the attenuation coefficient k, when decreasing accompanying an increase of the velocity, may not change at a constant rate. Furthermore, although the attenuation coefficient k decreases monotonically accompanying an increase of the velocity, the monotonic decrease and monotonic increase may be combined, or an entirety may monotonically increase. Anyway, the attenuation coefficient k may be defined to vary to the parameter values such as a sound volume (output level) in the case of the key depressing velocity or half-damper.

Because of being variously changeable depending on an effect to be aimed, also the waveform data is not necessarily limited to be obtained by sampling a sound of an acoustic piano. Namely, the wave form data may be one obtained by sampling a sound of an electric piano, or may be obtained by sampling a sound of other musical instrument. Furthermore, waveform data obtained by synthesizing or modifying predetermined wave form data may be used.

(2) Although, in the above embodiment, the decay rate of the envelope waveform is adjusted to control the attenuation velocity, the parameter may be adjusted by using a separate parameter. For example, when the release rate, the sustain rate or the like are used, the parameter may be adjusted. Furthermore, when the decay rate is determined for the first decay period and subsequent second decay period, any one of those (for example, the second decay period) or both of the decay rates may be adjusted.

(3) In the above-described embodiments, although the attenuation velocity k is defined by the attenuation control table, the velocity k may be calculated from the velocity or the like according to a predetermined computing equation.

(4) In the above-described embodiments, furthermore, the attenuation coefficient may be varied by an operation to a pedal other than the damper pedal 91, for example, to the shift pedal 93. According to this, when a vibration of the string is changed by a change of the number of hitting a string, if the relation between the damper and the string changed, the attenuation of the sound can be reproduced with accuracy.

(5) In the above-described embodiments, the case where the note-off is not detected in the attenuation control processing (FIG. 7, step S101, No) corresponds to a state where the key is depressed. Accordingly, in this case, irrespective of a state of the damper pedal, the attenuation coefficient is set to k=1. Namely, in order to simplifying the processing, with two states of the key depression and the key releasing postulated, a processing of switching existence and non-existence of an influence of the damper pedal is applied. On the other hand, in order to make more approach to an operation of an actual acoustic piano, also an intermediate state between the key depression state and the key releasing state may be reflected on the attenuation control processing.

Here, when an operable range of the key 70 is defined as an interval between a rest position and an end position, an intermediate state corresponds to that the key 70 is operated in the range between from the first position to the second position that do not contain the rest position and the end position. Furthermore, the first position is a position located closer to the end position than the second position. In this case, the key depression state corresponds to a state where the key 70 is located between the end position and the first position. Furthermore, the key releasing state corresponds to a state where the key 70 is located between the second position and the rest position. The first position and the second position are determined in advance. According to an intermediate state, even if in a state where the damper pedal 91 is not operated (damper-off), since the damper is in a state located a little off from the string, the half-damper state is obtained.

For example, as shown below, the processing at the time of the intermediate state is defined. In the determination processing of step S101 of FIG. 7, in the case of the key depression state (note-on) or key releasing state (note-off), the processing is the same as the processing in the above-described embodiments. On the other hand, when determined to be an intermediate state, even if in a state to be determined to be in a damper-off in a step S103 (a state where the damper pedal 91 is located in the rest position), a state of the half-damper is determined, the processing corresponding to the step S111, S113, S121 is executed. Namely, a state where the key 70 is in the intermediate state is determined to be a state of the half-damper, excluding a state determined to be the damper-on (a state where the damper-pedal 91 is located at the end position).

When thus performed, even if the damper pedal 91 is not operated, a state of the half-damper when the key 70 is operated to the intermediate state can be reproduced. Accordingly, the attenuation control processing in this example can process the half-damper corresponding to a state of the damper pedal 91, when the key 70 is located at a position closer to the rest position than the first position (intermediate state or key releasing state).

(6) In the embodiments described above, although the keyboard instrument 1 is described as one example of implementation, but it can be implemented also as the sound signal generation unit 800 contained in the keyboard instrument 1, namely as the sound signal generation device, furthermore, it can be also implemented as the sound source unit 80 containing the sound signal generation unit 800. In this case, from an input device having a keyboard and from an input device having a damper pedal, the first operation data and the second operation data may be acquired, information for generating the first operation data and the second operation data may be acquired.

(7) In the keyboard instrument 1 in the above-described embodiments, the chassis 50 and the pedal device 90 are configured removably from each other but may be housed integrally in the chassis but not mutually removably.

(8) An entirety or a part of each function of the above-described sound source unit 80 may be realized by execution of a control program due to a CPU of the control unit 10. In this case, a program of executing the attenuation control processing by the control unit 10 (computer) may be provided by downloading via a recording media or a network. Furthermore, by executing by downloading the program in a personal computer or the like, the computer may be used as the sound signal generation device.

REFERENCE SIGNS LIST

1 . . . Keyboard instrument, 10 . . . Control unit, 21 . . . Operation unit, 23 . . . Display unit, 30 . . . Memory unit, 50 . . . Chassis, 60 . . . Speaker, 73 . . . Pressure measurement unit, 75 . . . Key behavior measurement unit, 80 . . . Sound source unit, 88 . . . Conversion unit, 90 . . . Pedal device, 91 . . . Damper pedal, 93 . . . Shift pedal, 95 . . . Pedal behavior measurement unit, 111, 111A, 111B . . . Signal generation unit, 113 . . . Waveform reading unit, 115, 115A, 115B . . . EV waveform generation unit, 117 . . . Multiplier, 119 . . . Waveform synthesis unit, 121B . . . Reverberation addition unit, 131, 131A, 131B . . . Attenuation control unit, 135 . . . Attenuation control table, 151 . . . Waveform data memory unit, 180 . . . Output unit, 800 . . . Sound signal generation unit (Sound signal generation device)

What is claimed is:

1. A sound signal generation device comprising:

a memory storing instructions; and a processor that implements the instructions and execute a plurality of tasks, including:

a signal generation task that generates a sound signal based on first operation data corresponding to an operation to a key, the first operation data including an operation velocity of the key; and an attenuation control task that:

sets an attenuation velocity of the sound signal to one of at least a first attenuation velocity or a second attenuation velocity that is faster than the first attenuation velocity, based on both the first operation data and second operation data corresponding to an operation to a pedal; and in a state where the attenuation velocity is set to the second attenuation velocity, sets a value of the second attenuation velocity based on the operation velocity of the key or a pitch associated with the key.

2. The sound signal generation device according to claim 1, wherein:

the key is operable in a range of a rest position and an end position, the pedal is operable in a range of a rest position and an end position, and the attenuation control task sets the attenuation velocity to the second velocity when the second operation data indicates that the pedal is operated to a first position, which is between the rest position and the end position, and the key is at the rest position.

3. The sound signal generation device according to claim 1, wherein:

the key is operable in a range of a rest position and an end position, and the attenuation control task sets the attenuation velocity to the second attenuation velocity when the first operation data indicates that the key is operated closer to the rest position than a predetermined position, which is between the rest position and the end position.

4. The sound signal generation device according to claim 1, wherein the attenuation control task:

further sets the attenuation velocity to a third attenuation velocity, which is between the first attenuation velocity and the second attenuation velocity, based on both the first operation data and the second operation data; and in a state where the attenuation velocity is set to the third attenuation velocity, sets a value of the third attenuation velocity based on the operation velocity of the key, an amount of value settable to the third attenuation velocity being larger than an amount of value settable to the second attenuation velocity.

5. The sound signal generation device according to claim 1, wherein:

the key is operable in a range of a rest position and an end position, the pedal is operable in a range of a rest position and an end position, and the attenuation control task sets the attenuation velocity to the first attenuation velocity when the key is at the end position, and the pedal is at the rest position or the end position.

6. The sound signal generation device according to claim 1, wherein:

the key is operable in a range of a rest position and an end position, the pedal is operable in a range of a rest position and an end position, and the set value of the second attenuation velocity is smaller than the attenuation velocity to be set in a state where the pedal is at the rest position and the key is at the rest position.

7. A keyboard instrument comprising:

the sound signal generation device according to claim 1; and the key, wherein the plurality of tasks include a first operation data generation task that generates the first operation data corresponding to the operation of the key.

8. The keyboard instrument according to claim 7, further comprising:

the pedal, wherein the plurality of tasks include a second operation data generating task that generates the second operation data corresponding to the operation of the pedal.

9. A sound signal generation device comprising:

a memory storing instructions; and a processor that implements the instructions and execute a plurality of tasks, including:

a signal generation task that generates a sound signal based on first operation data corresponding to an operation to a key, the first operation data including an operation velocity of the key; and an attenuation control task that:

sets an attenuation velocity of the sound signal to one of at least a first attenuation velocity or a second attenuation velocity that is faster than the first attenuation velocity, based on both the first operation data and second operation data corresponding to an operation to a pedal; and in a state where the attenuation velocity is set to the second attenuation velocity, sets a value of the second attenuation velocity based on an output level of the sound signal.

10. The sound signal generation device according to claim 9, wherein:

the pedal is operable in the range of a rest position and an end position, and the attenuation control task sets the attenuation velocity to the second attenuation velocity when the second operation data indicates that the pedal is operated to a first position, which is between the rest position and the end position, and the key is at the rest Position.

11. The sound signal generation device according to claim 9, wherein:

the key is operable in a range of a rest position and an end position, and the attenuation control task sets the attenuation velocity to the second attenuation velocity when the first operation data indicates that the key is operated closer to the rest position than a predetermined position, which is between the rest position and the end position.

12. The sound signal generation device according to claim 9, wherein:

the key is operable in a range of a rest position and an end position, the pedal is operable in a range of a rest position and an end position, and the attenuation control task sets the attenuation velocity to the first attenuation velocity when the key is at the end position, and the pedal is at the rest position or the end position.

13. The sound signal generation device according to claim 9, wherein:

the key is operable in a range of a rest position and an end position, the pedal is operable in a range of a rest position and an end position, and the set value of the second attenuation velocity is smaller than the attenuation velocity to be set in a state where the pedal is at the rest position and the key is at the rest position.

14. A keyboard instrument comprising:

the sound signal generation device according to claim 9; and the key, wherein the plurality of tasks include a first operation data generation task that generates the first operation data corresponding to the operation of the key.

15. The keyboard instrument according to claim 14, further comprising:

the pedal, wherein the plurality of tasks include a second operation data generation task that generates the second operation data corresponding to the operation of the pedal.

16. A sound signal generation method comprising:

generating a sound signal based on first operation data corresponding to an operation to a key, the first operation data including an operation velocity of the key;

setting an attenuation velocity of the sound signal to one of at least a first attenuation velocity or a second attenuation velocity that is faster than the first attenuation velocity, based on both the first operation data and second operation data corresponding to an operation to a pedal; and in a state where the attenuation velocity is set to the second attenuation velocity, setting a value of the second attenuation velocity based on an operation velocity of the key or a pitch associated with the key.

* * * * *